US005891547A

United States Patent [19]

Lawless

[11] Patent Number: 5,891,547

[45] **Date of Patent: *Apr. 6, 1999**

[54] NEEDLE PUNCH NONWOVEN COMPONENT FOR REFASTENABLE FASTENING DEVICE

[75] Inventor: Barbara J. Lawless, Greensboro, N.C.

[73] Assignee: Precision Fabrics Group, Inc., Greensboro, N.C.

[ * ] Notice: This patent issued on a continued prosecution application filed under 37 CFR 1.53(d), and is subject to the twenty year patent term provisions of 35 U.S.C. 154(a)(2).

[21] Appl. No.: 795,375

[22] Filed: Feb. 4, 1997

[51] Int. Cl.[6] ..... B32B 3/06

[52] U.S. Cl. ..... 428/92; 428/86; 428/100; 442/402

[58] Field of Search ..... 428/92, 86, 100; 442/402

[56] References Cited

U.S. PATENT DOCUMENTS

| | | | |
|---|---|---|---|
| 3,694,867 | 10/1972 | Stumpf . | |
| 3,708,833 | 1/1973 | Ribich et al. . | |
| 4,258,097 | 3/1981 | Benedyk . | |
| 4,379,189 | 4/1983 | Platt | 428/92 |
| 4,391,866 | 7/1983 | Pickens, Jr. et al. | 428/92 |
| 4,424,250 | 1/1984 | Adams et al. . | |
| 4,600,618 | 7/1986 | Raychok, Jr. et al. . | |
| 4,645,699 | 2/1987 | Neveu . | |
| 4,654,246 | 3/1987 | Provost et al. . | |
| 4,739,635 | 4/1988 | Conley et al. . | |
| 4,761,318 | 8/1988 | Ott et al. | 428/100 |
| 4,981,749 | 1/1991 | Kubo et al. . | |
| 5,214,942 | 6/1993 | Peake, III et al. . | |
| 5,216,790 | 6/1993 | Eschenbach . | |
| 5,256,231 | 10/1993 | Gorman et al. . | |
| 5,267,453 | 12/1993 | Peake, III et al. . | |
| 5,304,162 | 4/1994 | Kuen . | |
| 5,326,612 | 7/1994 | Goulait . | |
| 5,380,313 | 1/1995 | Goulait et al. . | |
| 5,382,461 | 1/1995 | Wu | 428/86 |
| 5,383,872 | 1/1995 | Roessler et al. . | |
| 5,386,595 | 2/1995 | Kuen et al. . | |
| 5,391,424 | 2/1995 | Kolzer | 156/79 |
| 5,407,439 | 4/1995 | Goulait . | |
| 5,407,722 | 4/1995 | Peake, III et al. . | |
| 5,423,789 | 6/1995 | Kuen . | |
| 5,447,590 | 9/1995 | Gilpatrick | 428/100 |
| 5,449,530 | 9/1995 | Peake, III et al. . | |
| 5,470,417 | 11/1995 | Goulait . | |
| 5,476,702 | 12/1995 | Datta et al. . | |
| 5,500,268 | 3/1996 | Billarant . | |
| 5,518,795 | 5/1996 | Kennedy et al. . | |
| 5,554,239 | 9/1996 | Datta et al. . | |
| 5,569,233 | 10/1996 | Goulait . | |
| 5,595,567 | 1/1997 | King et al. . | |
| 5,614,281 | 3/1997 | Jackson et al. . | |
| 5,616,155 | 4/1997 | Kronzer | 428/100 |
| 5,647,864 | 7/1997 | Allen et al. . | |
| 5,654,070 | 8/1997 | Billarant . | |
| 5,669,900 | 9/1997 | Bullwinkel et al. . | |
| 5,669,901 | 9/1997 | LaFortune et al. . | |
| 5,707,707 | 1/1998 | Burnes et al. . | |
| 5,722,968 | 3/1998 | Datta et al. . | |

FOREIGN PATENT DOCUMENTS

| | | |
|---|---|---|
| 0 605 013 | 7/1994 | European Pat. Off. . |
| 0 765 616 | 4/1997 | European Pat. Off. . |
| 6-33359 | 2/1994 | Japan . |
| WO 96/03101 | 2/1996 | WIPO . |
| WO 96/14459 | 5/1996 | WIPO . |

OTHER PUBLICATIONS

Derwent Abstract AN 95–271468, JP Appln. 93 0343272 "Female Material For Hook And Loop Fastener," Nippon Vilene, Jul. 11, 1995.

JP 07 171011 (Jul. 11, 1995), Patent Abstract of Japan, vol. 095, No. 010, Nov. 30, 1995.

JP 06 033359 (Feb. 8, 1994), Patent Abstract of Japan, vol. 018, No. 257 (C–1200), May 17, 1994.

*Primary Examiner*—Terrel Morris

*Attorney, Agent, or Firm*—Finnegan, Henderson, Farabow, Garrett & Dunner

[57] ABSTRACT

The present invention relates to a nonwoven fabric for a hook and loop fastening device wherein the fabric comprises needlepunched fibers forming a plurality of loops which are effective for releasably engaging the hooks in a hook component, wherein the fabric has a weight of about 1.5 to about 4.0 ounces/sq. yd., and a thickness of about 0.015 inches to about 0.050 inches. The product may be used as fastening device for disposable products.

31 Claims, 3 Drawing Sheets

NEEDLE PUNCH NONWOVEN COMPONENT FOR REFASTENABLE FASTENING DEVICE

FIELD OF THE INVENTION

The present invention relates to a nonwoven, needlepunched fabric with loops on its surface. The present invention further relates to a releasable hook and loop refastening fastening system having a loop component and hook component. Finally, the present invention relates to a method of producing a hook and loop fastening system which includes the steps of needlepunching a batt of fibers to form a fabric with loops on its surface, and placing this fabric in contact with another fabric having hooks on its surface.

BACKGROUND OF THE INVENTION

It is often desirable to connect two surfaces securely together without producing a permanent bond. It also may be desirable to attach and subsequently detach these surfaces several times. A fastening device attaches two surfaces that are in contact with each other until a separating force is applied. A refastening fastening device allows the two surfaces to have repeated cycles of attachment and detachment.

One type of refastenable fastening device involves a male and female component. The male component, referred to herein as the hook component, is a fabric having a plurality of resilient, upstanding hook-shaped elements. The female component, referred to herein as the loop component, is a fabric having a plurality of upstanding loops. When the surfaces of the hook and loop components are pressed together, they become entangled. This creates a mechanical bond which will not disengage under normal conditions. The bond is held secure because it is difficult to break all of the bonds between the hooks and loops at one time. A gradual peeling force, however, releases the hooks from the loops and opens the fastener. As the peeling force is applied, the hooks, made of a resilient material, straighten and become disentangled from the loops of the loop component. The hooks and the loops are not destroyed by this separation and therefore can be reattached by again placing the hook and loop components in a face-to-face relationship.

Such hook and loop refastenable fastening devices are well known in the art and described in U.S. Pat. Nos. 2,717,437 and 3,009,235, the contents of which are incorporated herein in their entirety. These refastening fastening devices are commonly sold under the trademark "Velcro."

The loop component performs several functions in the mechanical bond formed in a refastening fastening device. For example, the loop component provides an entanglement area for the hooks to become attached. This area is where the mechanical bond is formed. The loop component also provides a space for the hooks. to remain while the fastener is closed.

The loop component is intended to engage and disengage the hook component several times during normal use. Just as the hooks of the hook component have a degree of resiliency to allow repeated use, the resiliency of the loops provides a degree of structural integrity allowing the loops to remain dimensionally stable during repeated use. After the components are separated, enough loops remain undamaged for reattachment to the hook component.

Hook and loop refastening fastening devices are useful for disposable articles, for example in disposable diapers.

However, their use has been limited due to the expense of the components. Conventional hook and loop components are typically made by weaving or knitting resilient yarn materials into a loop structure, and then cutting the loops when a hook structure is desired. Thus, these woven or knitted hook and loop components are systematic. The position of each yarn producing a loop is carefully determined before the fabric is produced. Such detailed manufacturing steps are often time consuming and expensive.

U.S. Pat. No. 3,694,867 issued to Stumpf discloses a loop component made with a "high loft" fabric attached to a backing layer. Fibers are mechanically manipulated to form the loops and are attached to the backing layer. These manufacturing steps add to the cost of the final loop component.

U.S. Pat. No. 4,739,635 to Conley relates to a loop component produced by feeding a backing layer into a knit stitch machine, where loops are knit into the backing layer at predetermined intervals. Example 5 of Conley shows that knitting without the backing layer resulted in a product lacking sufficient strength and stability to securely engage the hook component. The knitting steps are also complex and time consuming.

U.S. Pat. No. 4,600,618 to Raychock relates to a splint material with a hook and loop fastening device, where the loop component comprises needlepunched fibers. The Raychock patent, however, does not present any examples of the needlepunch fabric, and does not provide any details about the properties and characteristics of the loop component.

Accordingly, there exists a need for a low-cost refastening fastening loop component with high performance properties. Such a loop component should have an adequate range of caliper, weight, opacity, and peel strength. Preferably, the loops Withstand repeated cycles of attachment and detachment to the hook component.

Further, as disposable articles having hook and loop devices may be stored and/or sold under compression, a need exists for a loop component with favorable performance properties after such compression has been released.

SUMMARY OF THE INVENTION

It is therefore an object of the present invention to overcome the foregoing and other difficulties encountered in the prior art.

Another object of the present invention is to provide an inexpensive refastening fastening loop component having properties suitable for use with disposable articles.

Another object of the present invention is to provide a loop component having the ability to operate effectively under compression or after undergoing compression.

To achieve the objects and in accordance with the purpose of the invention, as embodied and broadly described herein, an embodiment of the invention relates to a nonwoven fabric for a hook-and-loop fastening device wherein the fabric has needlepunched fibers forming a plurality of loops which are effective for releasably engaging the hooks in the hook-and-loop fastening device, wherein the fabric has a thickness of about 0.015 inches to about 0.050 inches and is coated with a binder finish.

An embodiment of the invention also relates to a releasable hook-and-loop fastening system having a first fabric with a plurality of hooks, a nonwoven second fabric having a plurality of loops formed of needlepunched fibers effective for releasably engaging the hooks of said first fabric, wherein the nonwoven second fabric has a thickness of about 0.015 inches to about 0.050 inches and is coated with a binder.

Another embodiment of the invention relates to a nonwoven fabric for a hook-and-loop fastening device wherein the fabric has needlepunched fibers forming a plurality of loops which are effective for releasably engaging the hooks in the hook-and loop fastening device; wherein the fabric has a thickness of about 0.015 inches to about 0.050 inches and is attached to a substrate or backing layer.

Another embodiment of the invention relates to releasable, hook-and-loop fastening system having a first fabric having a plurality of hooks; a nonwoven second fabric having a plurality of loops formed of needlepunched fibers effective for releasably engaging the hooks of said first fabric; wherein the nonwoven second fabric has a thickness of about 0.015 inches to about 0.050 inches and is attached to a substrate or backing layer.

DETAILED DESCRIPTION OF THE INVENTION

The present invention relates to a nonwoven fabric for a hook and loop refastening fastening device that is made by an efficient and cost-effective process. In a most preferred embodiment, this is accomplished by a needlepunch process wherein a batt of fibers is needled to entangle the fibers to form a network of individual fiber loops. The needlepunch may then be finished by adding a binder to impart dimensional stability and allow the substrate to have multiple cycles of fastening without "fuzzing" for a limited use disposable article.

Figure 1:
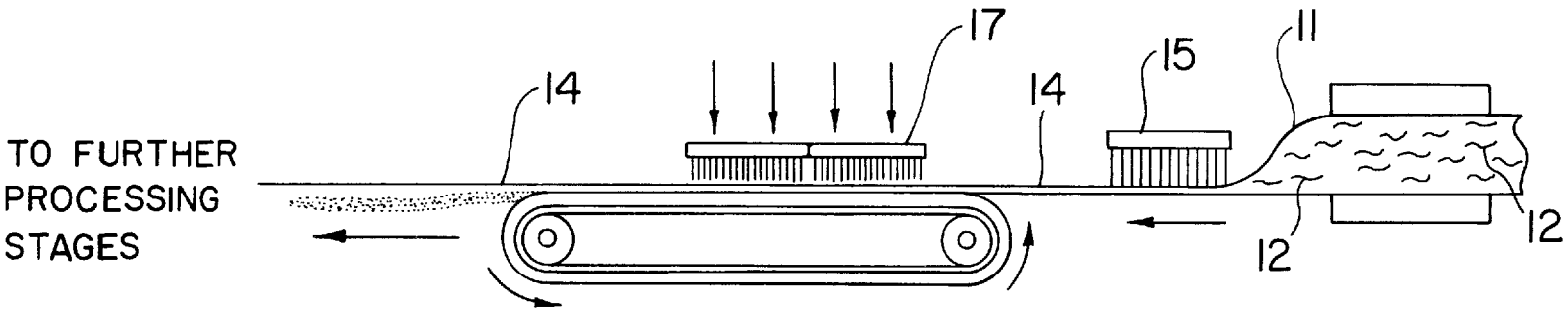
FIG. 1 shows an apparatus used for producing a nonwoven needlepunch fabric in accordance with the invention.

As shown in FIG. 1, nonwoven staple fibers 12 are provided in a continuous batt 11. The fibrous web or batt can be produced by any means well known in the art, such as by carding, airlaid, or spunbond equipment. The batt 11 is advanced to one or more needle looms 15 and 17, where the needle looms repeatedly work the batt into a fabric 14 having loops (not shown) on its surface.

In working the batt into the fabric 14, the needle looms, which contain barbed felting needles, entangle and mechanically interlock the fibers. As the needles are lowered, the blades of the barbs fill with fibers. These fibers are carried to a depth of penetration. When the needles are raised, the fibers are released by the barbs. The fibers are thus reoriented from the horizontal to vertical path with each pass of the needle loom. When the depth of penetration passes through the batt, loops are formed on the underside of the needled baft.

During processing, the number of needles per square inch entering the baft may vary. For example, about 500 to about 2000 needles may enter the batt per square inch. The baft may be needled from both sides or from one side. Subsequently, the needlepunched fabric may be passed on to further processing stages such as fusing and calendering stages.

The needlepunch manufacturing process and fiber selected affect the weight, caliper, loops produced, and transparency of the produced fabric. There are several variables in a needlepunch line that affect the weight and caliper of the produced fabric. These variables include the speed of the line, number of needlepunches per square area, type of felting needles, needlepunching from one or both sides of the batt, and depth of needle penetration. Increasing the speed of the belt in the needlepunch line reduces the amount of fiber per square area doffed off the baft supply equipment. Increasing the line speed therefore reduces the weight of the nonwoven fabric. The weight of the nonwoven fabric may also be increased by slowing the line speed and/or increasing the number of plies of fibers fed to the needlepunch line at once.

The degree of entanglement caused by needlepunching may affect the caliper and dimensional stability of the fabric. Increased entanglement leads to decreased caliper and increased dimensional stability of the product. A larger number of needle penetrations per square area entangles the fibers to a greater degree, thereby producing a fabric with a lower caliper. One may also increase the degree of entanglement by increasing the number of barbs per needle, the number of needles per square area, and/or the penetration depth of the needles. Also, working the batt with needle looms located on both sides of the baft increases entanglement and decreases the caliper of the fabric.

Fiber length, the number of needle penetrations, the number of barbs on each needle, and the depth of the needle penetrations also affect the size and number of loops in the produced fabric. Longer fibers used in the needlepunch baft may increases the number of loops and the height of the loops formed. If the fibers are too short, the needlepunching may reorient the fibers to a substantially complete vertical position instead of producing a loop. Increasing the number of needle penetrations per square area and barbs per needle also will increase the number of loops formed in the fabric;.

Fiber characteristics, such as the degree of luster and fiber denier, also influence the fabric's transparency. Luster may be varied by varying the amount of titanium dioxide in the fibers. Clear fibers, for example made without titanium dioxide, may be used to improve the clarity of the product. A clear loop component may add marketability to the hook and loop product by allowing the consumer to see a printed film placed beneath the loop component. The selection of a fine denier fiber for a given weight would decrease the transparency of the fabric as compared to a fabric having the same weight comprised of a coarser denier fiber.

In the present invention, fiber denier may range from about 3 to about 15 denier, with a preferred range of about 4 to about 10 denier. The finer the denier, the increased number of fibers needed to produce a fabric having a certain weight.

The fibers used to form the fabric of the present invention may include polyester, cotton, rayon, acetate, polypropylene, polyethylene, and nylon, and combinations thereof with polyester fibers as the most preferred embodiment.

The nonwoven fabric may have a basis weight of about 1.5 to about 4.0 ounces per square yard, preferably about 2.0 to about 4.0 ounces per square yard. The thickness or caliper may vary from about 0.015 to about 0.050 inches, more preferably about 0.025 to about 0.050 inches. The fiber length may be from about 1.5 to about 5 inches, with a preferred range of about 2 to about 5 inches.

The loop component in a hook and loop fastening system performs two functions. One, it attaches and reattaches to the hook component when the device is closed and two, it provides space where the hooks remain when the device is closed. The caliper of the fabric provides the space for the hooks of the hook component to remain during closure of the device. Decreasing the fiber denier will reduce the available space for the hooks to remain when the fastener is closed. This reduces the peel strength values by allowing the hooks to release much easier under force. With fine denier fibers, decreasing the amount of needling would increase the caliper, thus increasing the space available for the hooks to reside when the fastener is closed increasing the fabric peel strength. However, the increase in peel strength should be weighed against any reduction of dimensional stability. The final weight of the fabric is generally not a factor in determining the available space for the hooks to remain during closure of the device.

Additionally, the nonwoven fabrics of the present invention may be finished with a binder to decrease fiber slippage, thereby increasing the dimensional stability of the product. The use of a binder may also minimize the phenomenon of "fuzzing," i.e. distortion of the loop after one of more peels of the hook component. Application of a binder may be especially preferred when producing fabrics of lighter weights, e.g. fabrics below about 4.0 ounces per square yard. The addition of acrylic binders such as a blend of ethyl acrylate and butyl acrylate Rhoplex ST954 and a blend of ethyl acrylate and methyl methacrylate Rhoplex TR407 allows the fabric to remain flat, and decreases the phenomenon of fuzzing when the peeling force for separation from the hook component is applied. While acrylic binders are preferred, other chemical binders may be used such as styrenes, styrene butadienes, styrene acrylics, vinyls, vinyl acetates, vinyl acrylics, polyvinyl chlorides, polyvinylidene chlorides, urethanes, starches, polyesters, and polyacrylic acids. Such binders may be added to the loop component in an amount from about 2 to about 10 percent dry solids add-on.

The binders may be applied to the nonwoven fabrics of the present invention by any process well known in the art, such as a dip/nip saturation process, spraying, gravure coating, or kiss coating. The most preferred process is a dip/nip saturation process.

An embodiment of the invention can embrace a nonwoven fabric without a backing layer or substrate supporting the fibers. For example, a needlepunched fabric, either with or without a binder finish, may optionally be placed on a backing layer or substrate before being attached to the article which is to be fastened. The backing layer may be attached to the needlepunch fabric with an adhesive layer.

The backing layer may be a film, stable nonwoven fabric, lightweight woven fabric, or knit scrim. The film may be a polymer such as polyester, polyolefin, polyvinyl alcohol, block copolymer, elastomeric polymer, copolyester, urethane, styrene block copolymer, elastic foam, polyvinyl chloride, nylon, a polyethyl block amide such as Pebax®, or combinations thereof. The most preferred polymer is a low density polyethylene. The film thickness could range from about 0.00025 inches to about 0.010 inches, with the most preferred range being from about 0.0006 inches to about 0.002 inches. Corona treatment of the film is optional for this invention.

The thickness of the nonwoven fabric, the woven fabric, and the knit scrim may range from about 0.002 inches to about 0.05 inches.

A stable, lightweight nonwoven such as a spunbond, flashspun, resinbond, calendered needlepunch, thermal bond, or stitchbond could alternatively be used as the backing layer. When the greige needlepunch is laminated to any of the above fabrics, the backing layer provides added dimensional stability which is desirable for .a fastening device intended for a number of fastening cycles. A woven or knit scrim could also be used as a backing layer for the needlepunch fabric.

The adhesive layer performs two functions. One, it attaches the needlepunch to the backing layer which gives the needlepunch additional dimensional stability. Two, the adhesive locks the fibers in the substrate. Without the adhesive, the fibers of the needlepunch loop component may pull out of the fabric during separation or peeling of the corresponding hook component, thereby causing fuzzing. The adhesive layer may be a pressure sensitive block copolymer thermoplastic rubber, polyester, urethane, polyamide, acrylic, silicon, water-based adhesive (e.g. Latex), synthetic rubber, or ethyl vinyl acetate. The most preferred adhesive is a pressure sensitive thermoplastic rubber. The adhesive add-on may be about 6 grams per square meter to about 50 grams per square meter, with the most preferred range being between about 8 grams per square meter and about 20 grams per square meter.

Where a backing layer is used, the backing layer may be attached to the needlepunched fabric with a hot melt laminator. However, any method of adhesive application lamination would be sufficient, such as gravure coating, spraying, transfer coating, screen printing, powder bonding, flame, thermal, or extrusion coating. Thermal coating methods include calendering, point bonding, and adhesive web coating.

In hot melt lamination, two substrates, the fabric and backing, are threaded into the laminator. The adhesive is melted and pushed through a slot opening so it can be applied to one substrate. After application of the adhesive, the two substrates are contacted prior to entering nip of a roller assembly. The pressure at the nip is limited to the weight of the top nip roll. After passing through the nip, the two substrates are adhered to one another and batched.

The hook component used in combination with the loop component described herein may have a conventional structure made of conventional materials. For example, the hooks of the hook component may be T-shaped, mushroom shaped, or may be beaded stems. As used herein, the terms "hook" and "hooks" embrace these structures and their substantial equivalents.

The peel strength achievable with the loop component of the present invention favorably compares to the peel strength of current fastening devices in the disposable products market. For example, fasteners for the disposable diaper industry may commonly have a peel strength of at least 500 grams per inch. A refastening fastening system with a loop component described herein may have a peel strength ranging from about 150 to about 1600 grams per inch. An even more preferred range for peel strength is about 500 to about 1250 grams per inch. This strength may depend in part on the type of hook component used in combination with the loop component to form the hook and loop fastening system.

The present invention has use for articles which are vacuum packed or shrink wrapped for reduced packing expense and improved handling. Such articles include disposable diapers. With this in mind, the loop component should maintain its desirable properties after it has been exposed to compression. The Examples below therefore contain data from samples exposed to a compression of 0.22 pounds per square inch for two hours. Increased compression up to 10 pounds per square inch yielded no significant change in the data produced. Similarly, maintaining the pressure for periods of time longer than two hours produced no significant change in the data.

EXAMPLE 1

A batt of 6 denier, three inch polyester clear fibers were carded and needled in a needlepunch apparatus. During processing, approximately 990 needles entered the fiber batt per square inch. Needle punched fabrics were produced having a griege weight basis of 2.0 ounces per square yard with a thickness of 0.033 inches, and a griege weight basis of 3.0 ounces per square yard with a thickness of 0.037 inches. These weights produced enough fiber loops for entanglement and mechanical bonding of a hook component. The produced fabric had a degree of transparency because of the denier size and fiber selection, thereby providing a view of the surface to which the loop component is attached.

A dip/nip saturation finishing process was utilized to add a soft, resilient acrylic: binder (Rhoplex ST954 ) and a stiff acrylic binder (Rhoplex TR407 ) at 4% dry solids add-on to the samples. The ratio of the binders was 4 to 1, respectively. A trough, holding the binder, was placed prior to rollers arranged to form a nip. The unfinished or "griege" fabric was passed through the trough to completely saturate the fabric, and then passed through the squeeze rollers to reduce the amount of finish on the fabric to about 150 percent by weight wet pick up, which corresponded to 4% by weight dry solids add-on. At this point the fabric was put onto a pin tenter frame where it was exposed to a 400° F. for 22 seconds in a gas fired convection oven. After drying and curing, the fabric was removed from the pins and batched onto a core. To decrease cost, basis weight, and opacity, the fabric was also stretched 10 percent on tenter frame.

EXAMPLE 2

Loop components were produced by the method described in Example 1, except that no binder was added to the fabric and the fabric was not stretched. Such a fabric, is referred to herein as a "griege" fabric.

EXAMPLE 3

The loop components produced as set forth in Example 1 and Example 2 were combined with a P87 hook component obtained from Velcro, USA to form a hook and loop fastening system. All samples were subjected to a compression of 0.22 pounds per square inch for two hours. To test the dimensional stability of the samples, the loop components having width of one inch and a length of eight inches were subjected to five peels of the hook component. The dimensions of the loop component were each peel, and the results of several tests averaged. The averaged results are shown below in Tables 1 and 2.

TABLE 1

(2.0 ounces per square yard)

| Peels | Example 1 Width (inches) | Example 2 Width (inches) | Example 1 Length (inches) | Example 2 Length (inches) |
|---|---|---|---|---|
| 0 | 1.0 | 1.0 | 8.0 | 8.0 |
| 1 | 1.0 | 0.5 | 8.0 | 9.8 |
| 2 | 1.0 | 0.3 | 8.0 | 10.2 |
| 3 | 1.0 | 0.3 | 8.0 | 10.1 |
| 4 | 1.0 | 0.4 | 8.0 | 10.2 |
| 5 | 1.0 | 0.4 | 8.0 | 10.4 |

TABLE 2

(3.0 ounces per square yard)

| Peels | Example 1 Width (inches) | Example 2 Width (inches) | Example 1 Length (inches) | Example 2 Length (inches) |
|---|---|---|---|---|
| 0 | 1.0 | 1.0 | 8.0 | 8.0 |
| 1 | 1.0 | 0.4 | 8.0 | 9.6 |
| 2 | 1.0 | 0.4 | 8.0 | 9.6 |
| 3 | 1.0 | 0.4 | 8.0 | 9.5 |
| 4 | 0.9 | 0.4 | 8.0 | 9.6 |
| 5 | 0.9 | 0.4 | 8.1 | 9.4 |

Figure 2:
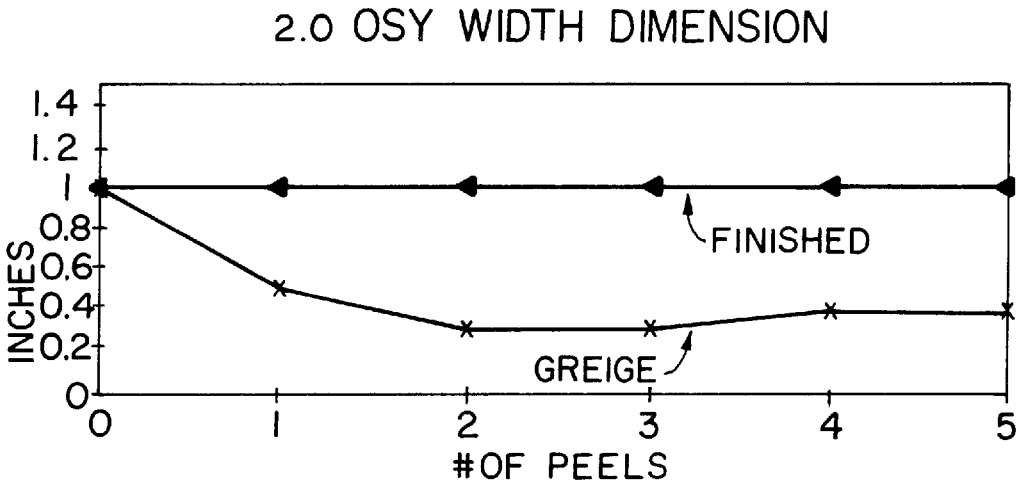
FIG. 2 is a graph showing the dimensional stability with regard to width of finished and unfinished 2.0 ounce per square yard nonwoven loop components.
Figure 3:
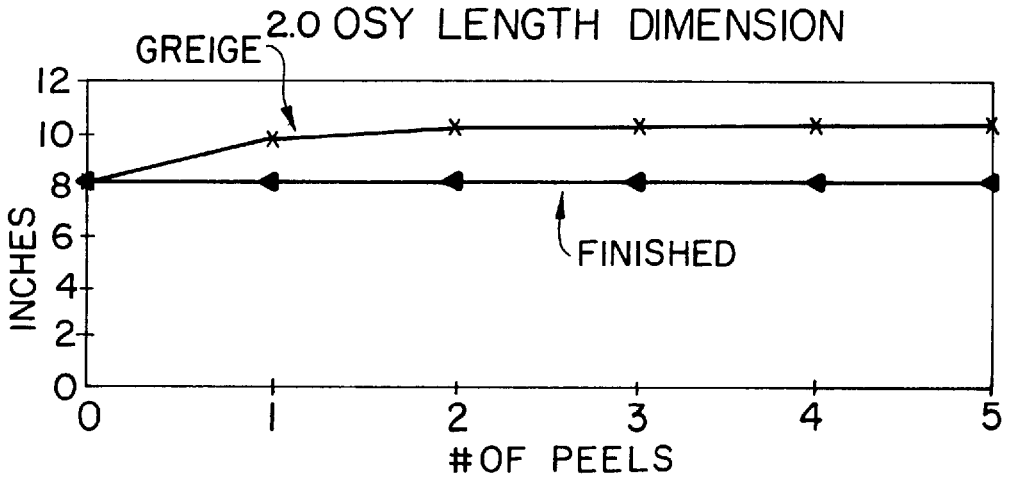
FIG. 3 is a graph showing the dimensional stability with regard to length of finished and unfinished 2.0 ounce per square yard nonwoven loop components.
Figure 4:
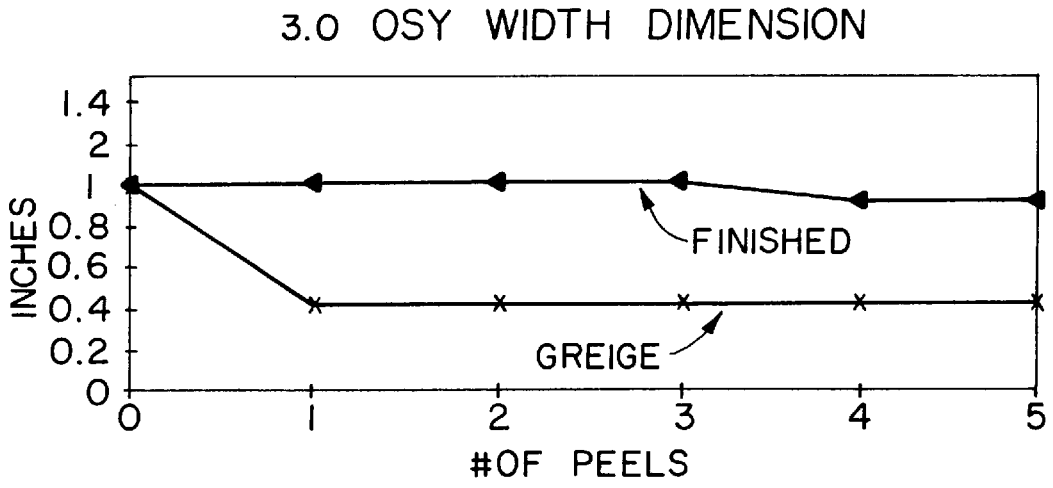
FIG. 4 is a graph showing the dimensional stability with regard to width of finished and unfinished 3.0 ounce per square yard nonwoven loop components.
Figure 5:
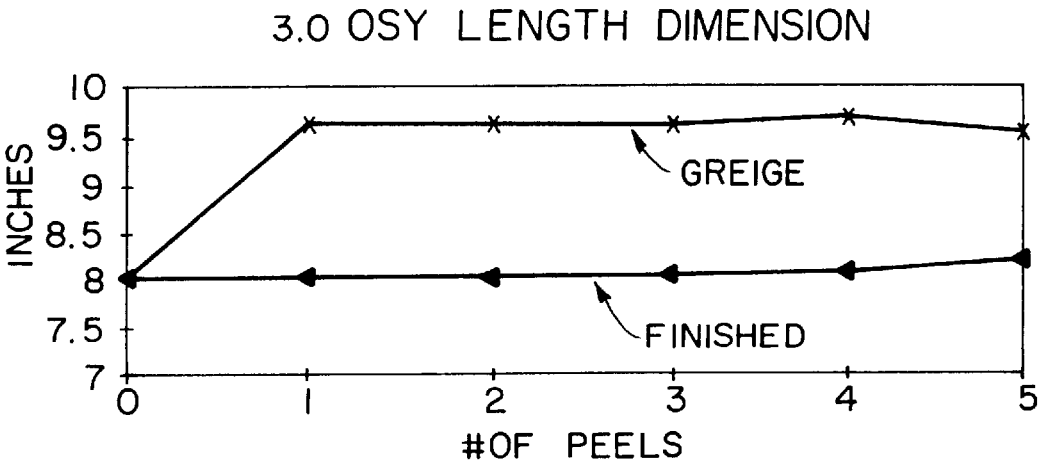
FIG. 5 is a graph showing the dimensional stability with regard to length of finished and unfinished 3.0 ounce per square yard nonwoven loop components.

As can be seen in Tables 1 and 2, the finished products of Example 1 substantially maintained dimensional stability through five peels. In contrast, the griege fabrics of Example 2 deformed after the second peel. FIGS. 2 and 3 graphically depict these results for the products of Example 1 and Example 2, where each loop component had a griege weight basis of 2.0 ounces per square yard. FIGS. 4 and 5 graphically depict the results of the above peel tests for the products of Example 1 and Example 2, where each loop component had a griege weight basis of 3.0 ounces per square yard.

EXAMPLE 4

Loop components produced as set forth in Example 1 and Example 2 were combined with a P87 hook component obtained from Velcro, USA to form a hook and loop fastening system. All samples were subjected to a compression of 0.22 pounds per square inch for two hours. The peel strengths of these fastening systems were tested according to the method set forth in ASTM D5170-91, the entire contents of which are incorporated herein by reference. All peels were performed across the machine direction of the fabric. Tables 3 and 4 show the average of the five highest peel strenghts for each peel.

TABLE 3

(2.0 ounces per square yard)

| Peel | Example 1 Peel Strength (grams) | Example 2 Peel Strength (grams) |
|---|---|---|
| 1 | 363 | 753 |
| 2 | 314 | 893 |
| 3 | 250 | 470 |
| 4 | 228 | 403 |
| 5 | 216 | 373 |

TABLE 4

| Peel | Example 1 Peel Strength (grams) (3.0 ounces per square yard) | Example 2 Peel Strength (grams) (3.0 ounces per square yard) |
|---|---|---|
| 1 | 938 | 3655 |
| 2 | 730 | 1060 |
| 3 | 655 | 485 |
| 4 | 631 | 635 |
| 5 | 505 | 585 |

As Tables 3 and 4 show, the loop components finished with a binder in accordance with Example 1 exhibited a more uniform peel strength through five peels, than the unfinished griege loop components of Example 2.

The lamination of the film to the needlepunch allows the fabric to perform as al female component in a hook and loop fastening system without being distorted due to the stress of separating. A greige needlepunch which is not laminated will increase in length in the direction of the peeling force and decrease in width in the perpendicular direction to the peeling force. For example, using the procedure outlined in ASTM D5170-91, an unlaminated needlepunch sample which is 8 inches in length and 1 inch in with will increase 30% in length to 10.4 inches and decrease 63% in width to 0.4 inches after 5 peels with the hook component. The same needlepunch after lamination will increase 2% in length to 8.1 inches and decrease 6% in width to 0.9 inches after 5 peels with the hook component. The hook component used to perform the peel strength test was P87 from Velcro USA®. Laminating the film to the greige needlepunch gives the fabric a support, thus not allowing it to be distorted by the peeling force of separation.

EXAMPLE 5

The underside of a greige needlepunch fabric of Example 2 was coated, using a hot melt slot coater, with a pressure sensitive thermoplastic rubber adhesive that had been heated to a tacky viscous liquid. The adhesive add-on was 6 grams per square meter. The underside coated with the adhesive was then contacted with a 0.75 mil clear, corona-treated low density polyethylene film as a backing layer. The needlepunch fabric and the film were then passed through the nip of a roller assembly to form a laminated article.

The dimensional stability of the laminated article was then tested by contacting the side having the needlepunch fabric with a P87 hook component obtained from Velcro, USA. The hook component was peeled and reattached five times according to the method described in ASTM D5170-91. After five peels, the dimensions of the needlepunch fabric, which was initially 8 inches in length and 1.0 inch in width, increased to 8.1 inches in length and decreased to 0.9 inches in width.

Other embodiments of the invention will be apparent to those skilled in the art from consideration of the specification and practice of the invention disclosed herein. The invention may have many uses, such as for disposable and nondisposable diapers, or disposable and nondisposable garments used in the service industry, such as smocks, gloves, or gowns. The invention may similarly have use in attaching carpet tiles to a floor. It is intended that the specification and examples be considered as exemplary only, with the invention being defined by the following claims.

I claim:

1. A nonwoven fabric for a hook-and-loop fastening device wherein the fabric comprises:

needlepunched fibers forming an entanglement zone having a plurality of loops for releasably engaging the hooks in the hook-and-loop fastening device;

wherein the fabric has a binder present in the entanglement zone and a thickness of about 0.015 inches to about 0.050 inches.

2. The fabric of claim 1, wherein the weight is about 1.5 to about 4.0 oz./sq. yd.

3. The fabric of claim 1, wherein the needlepunched fibers have a denier of about 3 to about 15.

4. The fabric of claim 1 having a thickness of about 0.025 inches to about 0.050 inches.

5. The fabric of claim 1, wherein the fibers have a length of about 1.5 inches to about 5.0 inches.

6. The fabric of claim 1, wherein the fibers are selected from the group consisting of polyester fibers, cotton fibers, rayon fibers, acetate fibers, polypropylene fibers, nylon fibers, and combinations thereof.

7. The fabric of claim 1, wherein the binder is selected from the group consisting of acrylics, styrenes, styrene butadienes, styrene acrylics, vinyls, vinyl acetates, vinyl acrylics, polyvinyl chlorides, polyvinylidene chlorides, urethanes, starches, polyesters, and polyacrylic acids.

8. The fabric of claim 1, wherein the fabric has no substrate or backing layer supporting the needlepunched fibers.

9. The fabric of claim 1, wherein the fabric is attached to a substrate or backing layer.

10. The nonwoven fabric of claim 9 wherein the substrate or backing layer is selected from the group consisting of a polymer film, a nonwoven fabric, a woven fabric, or a knit scrim.

11. The fabric of claim 1, wherein the binder is present throughout the thickness of the fabric.

12. The fabric of claim 1, wherein the binder is applied to the fabric by dip/nip saturation, spraying, gravure coating, or kiss coating.

13. The fabric of claim 1, wherein the needlepunched fibers are comprised of polypropylene.

14. The fabric of claim 1, wherein the fabric has been thermally fused or calendered.

15. A releasable, hook-and-loop fastening system comprising:

a first fabric having a plurality of hooks, a nonwoven second fabric having an entanglement zone of a plurality of loops formed of needlepunched fibers for releasably engaging the hooks of said first fabric, wherein the nonwoven second fabric has a thickness of about 0.015 inches to about 0.050 inches, and has a binder in the entanglement zone.

16. The fastening system of claim 15, wherein the second fabric has a weight of about 1.5 to about 4.0 oz./sq. yd.

17. The fastening system of claim 15, wherein the needlepunched fibers have a denier of about 3 to about 15.

18. The fastening system of claim 15, wherein the second fabric has a thickness of about 0.025 inches to about 0.050 inches.

19. The fastening system of claim 15, wherein the fibers have a length of about 1.5 inches to about 5.0 inches.

20. The fastening system of claim 15, wherein the fibers are selected from the group consisting of polyester fibers, cotton fibers, rayon fibers, acetate fibers, polypropylene fibers, nylon fibers, and combinations thereof.

21. The fastening system of claim 15, wherein the binder is selected from the group consisting of acrylics, styrenes, styrene butadienes, styrene acrylics, vinyls, vinyl acetates, vinyl acrylics, polyvinyl chlorides, polyvinylidene chlorides, urethanes, starches, polyesters, polyacrylic acids and combinations thereof.

22. The fastening system of claim 15, wherein the binder is present throughout the thickness of the second fabric.

23. The fastening system of claim 15, wherein the binder is applied to the second fabric by dip/nip saturation, spraying, gravure coating, or kiss coating.

24. The fastening system of claim 15, wherein the needlepunched fibers are comprised of polypropylene.

25. The fastening system of claim 15, wherein the second fabric has been thermally fused or calendered.

26. A releasable, hook-and-loop fastening system comprising:

a first fabric having a plurality of hooks, a nonwoven second fabric having an entanglement zone of a plurality of loops formed of needlepunched fibers effective for releasably engaging the hooks of said first fabric, wherein the nonwoven second fabric has a thickness of about 0.015 inches to about 0.050 inches, a binder present in the entanglement zone, and has a second surface attached to a substrate or backing layer.

27. The fastening system of claim 26 wherein the substrate or backing layer is selected from the group consisting of a polymer film, a nonwoven fabric, a woven fabric, or a knit scrim.

28. The fastening system of claim 26, wherein the binder is present throughout the thickness of the second fabric.

29. The fastening system of claim 26, wherein the binder is applied to the second fabric by dip/nip saturation, spraying, gravure coating, or kiss coating.

30. The fastening system of claim 26, wherein the needlepunched fibers are comprised of polypropylene.

31. The fastening system of claim 26, wherein the second fabric has been thermally fused or calendered.

* * * * *